US008069039B2

(12) United States Patent
Yoshioka

(10) Patent No.: US 8,069,039 B2
(45) Date of Patent: Nov. 29, 2011

(54) SOUND SIGNAL PROCESSING APPARATUS AND PROGRAM

(75) Inventor: Yasuo Yoshioka, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 881 days.

(21) Appl. No.: 11/962,439

(22) Filed: Dec. 21, 2007

(65) Prior Publication Data

US 2008/0154585 A1 Jun. 26, 2008

(30) Foreign Application Priority Data

Dec. 25, 2006 (JP) ..... 2006-347788
Dec. 25, 2006 (JP) ..... 2006-347789

(51) Int. Cl.
*G10L 19/00* (2006.01)

(52) U.S. Cl. ..... 704/213; 704/214; 704/210; 704/208

(58) Field of Classification Search ..... 704/206, 704/233, 207, 208, 209, 210, 213, 214, 215, 704/248, 270
See application file for complete search history.

(56) References Cited

U.S. PATENT DOCUMENTS

| | | | | |
|---|---|---|---|---|
| 4,984,275 | A | 1/1991 | Watanabe et al. | |
| 5,649,055 | A * | 7/1997 | Gupta et al. | 704/233 |
| 5,963,901 | A * | 10/1999 | Vahatalo et al. | 704/233 |
| 5,970,447 | A | 10/1999 | Ireton | |
| 7,412,376 | B2 * | 8/2008 | Florencio et al. | 704/206 |

FOREIGN PATENT DOCUMENTS

| | | | |
|---|---|---|---|
| EP | 237 934 | A1 | 9/1987 |
| EP | 944 036 | A1 | 9/1999 |
| JP | 06-266380 | | 9/1994 |
| JP | 08-292787 | | 11/1996 |
| JP | 08-314500 | | 11/1996 |
| JP | 11-095785 | | 4/1999 |
| JP | 2000-310993 | | 11/2000 |
| JP | 2001-166783 | | 6/2001 |
| JP | 2001-265367 | | 9/2001 |
| JP | 2003-101939 | | 4/2003 |
| JP | 2006-078654 | | 3/2006 |
| WO | WO-01/29821 | A1 | 4/2001 |

OTHER PUBLICATIONS

Notice of Reason for Rejection for Japanese Patent Application No. 2006-347788, mailed Dec. 2, 2008 (4 pages).
Notice of Reason for Rejection for Japanese Patent Application No. 2006-347789, mailed Dec. 2, 2008 (5 pages).
01X Supplementary Manual Using the 01X with Cubase SX "3", Yamaha Corporation, 2003.
Partial European Search Report mailed Sep. 26, 2011, for EP Patent Application No. 07024994.1, eight pages.

* cited by examiner

*Primary Examiner* — Huyen X. Vo
(74) *Attorney, Agent, or Firm* — Morrison & Foerster LLP

(57) ABSTRACT

In a sound signal processing apparatus, a frame information generation section generates frame information of each frame of a sound signal. A storage stores the frame information generated by the frame information generation section. A first interval determination section determines a first utterance interval in the sound signal. A second interval determination section determines a second utterance interval based on the frame information of the first utterance interval stored in the storage such that the second utterance interval is made shorter than the first utterance interval and confined within the first utterance interval by trimming frames from either of a start point or an end point of the first utterance interval.

13 Claims, 7 Drawing Sheets

SOUND SIGNAL PROCESSING APPARATUS AND PROGRAM

BACKGROUND OF THE INVENTION

1. Technical Field

The present invention relates to a technology for processing a sound signal indicative of various types of audio, such as voice and musical sound, and particularly to a technology for identifying an interval in which a predetermined voice in a sound signal is actually pronounced (hereinafter referred to as "utterance interval").

2. Background Art

Voice analysis, such as voice recognition and voice authentication (speaker authentication), uses a technology for segmenting a sound signal into an utterance interval and a non-utterance interval (period containing only noise related to the surroundings). For example, a period in which the S/N ratio of the sound signal is greater than a predetermined threshold value is identified as the utterance interval. Patent Document JP-A-2001-265367 discloses a technology for comparing the S/N ratio in each period obtained by segmenting a sound signal with the S/N ratio in a period that has been judged to be a non-utterance interval in the past so as to determine whether the period is an utterance interval or a non-utterance interval.

However, since the technology disclosed in Patent Document JP-A-2001-265367 only compares the S/N ratio in each period of the sound signal with the S/N ratio in a past non-utterance interval to determine whether the period is an utterance interval or a non-utterance interval, a period containing instantaneous noise, such as cough sound, lip noise, and sound produced in the mouth, made by the speaker (a period that should be normally judged as a non-utterance interval) is likely misidentified as an utterance interval.

SUMMARY OF THE INVENTION

In view of the above circumstances, an object of the invention is to improve accuracy in identifying an utterance interval.

To achieve the above object, the sound signal processing apparatus according to the invention includes a frame information generation section for generating frame information of each frame of a sound signal, a storage section for storing the frame information generated by the frame information generation section, a first interval determination section for determining a first utterance interval (the utterance interval P1 in FIG. 2, for example) in the sound signal, and a second interval determination section for determining a second utterance interval (the utterance interval P2 in FIG. 2, for example) by shortening the first utterance interval based on the frame information stored in the storage section for each frame of the first utterance interval determined by the first interval determination section.

According to the above configuration, the second utterance interval is determined by shortening the first utterance interval based on the frame information of each frame. The accuracy in identification of an utterance interval can therefore be improved, as compared to a configuration in which single-stage processing determines an utterance interval (a configuration that identifies only the first utterance interval, for example). While any specific contents of the frame information and any specific method for identifying the second utterance interval based on the frame information are used in the invention, exemplary forms to be employed are described in the following sections.

In a first form, the frame information contains a signal index value representative of the signal level of the sound signal in each frame (the signal level HIST_LEVEL and the S/N ratio R in the following embodiment, for example). The second interval determination section identifies the second utterance interval by removing frames from a plurality of frames in the first utterance interval, the frames to be removed being either of one or more successive frames from the start point of the first utterance interval or one or more successive frames upstream from the end point of the first utterance interval, each of the frames to be removed being a frame in which the signal index value contained in the frame information is lower than a threshold value (the threshold value TH1 in FIG. 6, for example) which is determined according to the maximum signal index value in the first utterance interval.

Further in the first form, the second interval determination section identifies the second utterance interval by removing frames when the sum of the signal index values for a predetermined number of successive frames from the start point of the first utterance interval is lower than a threshold value (the threshold value TH2 in FIG. 6, for example) which is determined according to the maximum signal index value in the first utterance interval, the frames to be removed being one or more frames on the start point side among the predetermined number of the frames. Similarly, the second interval determination section identifies the second utterance interval by removing frames when the sum of the signal index values for a predetermined number of successive frames upstream from the end point of the first utterance interval is lower than a threshold value determined according to the maximum signal index value in the first utterance interval, the frames to be removed being one or more frames on the end point side among the predetermined number of frames.

The configuration in which the second utterance interval is thus identified according to the maximum signal index value in the first utterance interval allows effective elimination of noise (cough sound and lip noise made by the speaker, for example) produced before and after the second utterance interval containing actual speech. A specific example of the first form will be described later as a first embodiment.

In a second form, the frame information contains pitch data indicative of the result of detection of the pitch of the sound signal in each frame. The second interval determination section identifies the second utterance interval by removing frames from the first utterance interval, the frames to be removed being either one or more successive frames from the start point of the first utterance interval or one or more successive frames upstream from the end point of the first utterance interval, each of the frames to be removed being a frame in which the pitch data contained in the frame information indicates that no pitch has been detected. The above form allows effective elimination of noise from which no pitch is clearly identified, such as wind noise. A specific example of the second form will be described later as a second embodiment.

In a third aspect, the frame information contains a zero-cross number for the sound signal in each frame. The second interval determination section identifies the second utterance interval by removing frames when a plurality of successive frames upstream from the end point of the first utterance interval have the zero-cross number greater than a threshold value, the frames to be removed being frames other than a predetermined number of frames on the start point side among the plurality of the frames. According to the above form, a plurality of frames upstream from the end point of the first utterance interval, each of the frames being a frame in which the zero-cross number is greater than a threshold value (unvoiced consonant), are removed, but a predetermined number of such frames are left. It is therefore possible to adjust the end of the speech (unvoiced consonant) to a predetermined time length.

The sound signal processing apparatus according to a preferred aspect of the invention includes an acquisition section for acquiring a start instruction (the switching section 583 in FIG. 3, for example), a noise level calculation section for calculating the noise level of frames in the sound signal before the acquisition section acquires the start instruction, and an S/N ratio calculation section for calculating the S/N ratio of the signal level of each frame in the sound signal after the acquisition section has acquired the start instruction relative to the noise level calculated by the noise level calculation section. The first interval determination section identifies the first utterance interval based on the S/N ratio calculated for each frame by the S/N ratio calculation section. According to the above aspect, since each frame before the start instruction is acquired is regarded as noise and the S/N ratio after the start instruction has been acquired is calculated for each frame, the first utterance interval can be identified in a highly accurate manner.

The sound signal processing apparatus according to a preferred aspect of the invention includes a feature value calculation section for sequentially calculating a feature value for each frame in the sound signal, the feature value being used by a sound analysis device to analyze the sound signal, and an output control section for sequentially outputting the feature value of each frame contained in the first utterance interval identified by the first interval determination section to the sound analysis device whenever the feature value calculation section calculates the feature value. The second interval determination section notifies the sound analysis device of the second utterance interval. In the above aspect, since the feature value calculated by the feature value calculation section is sequentially outputted to the sound analysis device, the sound signal processing apparatus does not need to hold the feature values for all frames that belong to the first utterance interval. There is therefore provided advantages of reduction in the scale of the circuit in the sound signal processing apparatus and the processing load on the sound signal processing apparatus. These advantageous effects are particularly significant when the amount of data of the frame information on each frame is less than the amount of data of the feature value for each frame. Since the sound analysis device is notified of the second utterance interval identified by the second interval determination section, the sound analysis device can selectively use the feature values for the frames that belong to the second utterance interval among the feature values acquired from the output control device to analyze the sound signal. There is therefore provided an advantage of improvement in accuracy of analysis of the sound signal performed by the sound analysis device.

In a preferred aspect of the invention, the storage section stores frame information of each frame within the first utterance interval identified by the first interval determination section. According to this aspect, the capacity required for the storage section can be reduced, as compared to a configuration in which the storage section stores frame information of all frames in the sound signal. It is not, however, intended to eliminate the configuration in which the storage section stores frame information on all frames in the sound signal from the scope of the invention.

In a preferred aspect of the invention, the output control section outputs the feature value for each frame of the first utterance interval identified by the first interval determination section to the sound analysis device. More specifically, the first interval determination section includes a start point identification section for identifying the start point of the first utterance interval and an end point identification section for identifying the end point of the first utterance interval. The output control section is triggered by the identification of the start point made by the first start point identification section to start outputting the feature value to the sound analysis device, and triggered by the identification of the end point made by the first end point identification section to stop outputting the feature value to the sound analysis device. According to the above aspect, since only the feature value for each frame of the first utterance interval among the feature values calculated by the feature value calculation section is selectively outputted to the sound analysis device, the capacity for holding feature values in the sound analysis device can be reduced.

The invention is also practiced as a method for operating the sound signal processing apparatus according to each of the above aspects (a method for processing a sound signal). In the method for processing a sound signal according to an aspect of the invention, a feature value that the sound analysis device uses to analyze a sound signal is sequentially calculated for each frame in the sound signal and sequentially outputted to the sound analysis device. On the other hand, the first utterance interval in the sound signal is identified, and frame information is generated for each frame in the sound signal and stored in the storage section. The second utterance interval is identified by shortening the first utterance interval based on the frame information stored in the storage section and notifying the sound analysis device of the second utterance interval. The method described above provides an effect and an advantage similar to those of the sound signal processing apparatus according to the invention.

The sound signal processing apparatus according to each of the above aspects is embodied not only by hardware (an electronic circuit), such as DSP (Digital Signal Processor), dedicated to each process but also by cooperation between a general-purpose arithmetic processing unit, such as a CPU (Central Processing Unit), and a program. The program according to the invention instructs a computer to execute the feature value calculation process of sequentially calculating a feature value for each frame in a sound signal, the feature value being used by the sound analysis device to analyze the sound signal, the frame information generation process of generating frame information on each frame in the sound signal and storing the frame information in the storage section, the first interval determination process of identifying the first utterance interval in the sound signal, the output control process of sequentially outputting the feature value calculated in the feature value calculation process to the sound analysis device, and the second interval determination process of identifying the second utterance interval by shortening the first utterance interval based on the frame information stored in the storage section, and notifying the sound analysis device of the second utterance interval. The program described above also provides an effect and an advantage similar to those of the sound signal processing apparatus according to the invention. The program according to the invention is provided to users in the form of a machine-readable medium or a portable recording medium, such as a CD-ROM, having the program stored therein, and installed in a computer, or provided from a server in the form of delivery over a network and installed in a computer.

DETAILED DESCRIPTION OF THE INVENTION

A: First Embodiment

A-1: Configuration

Figure 1:
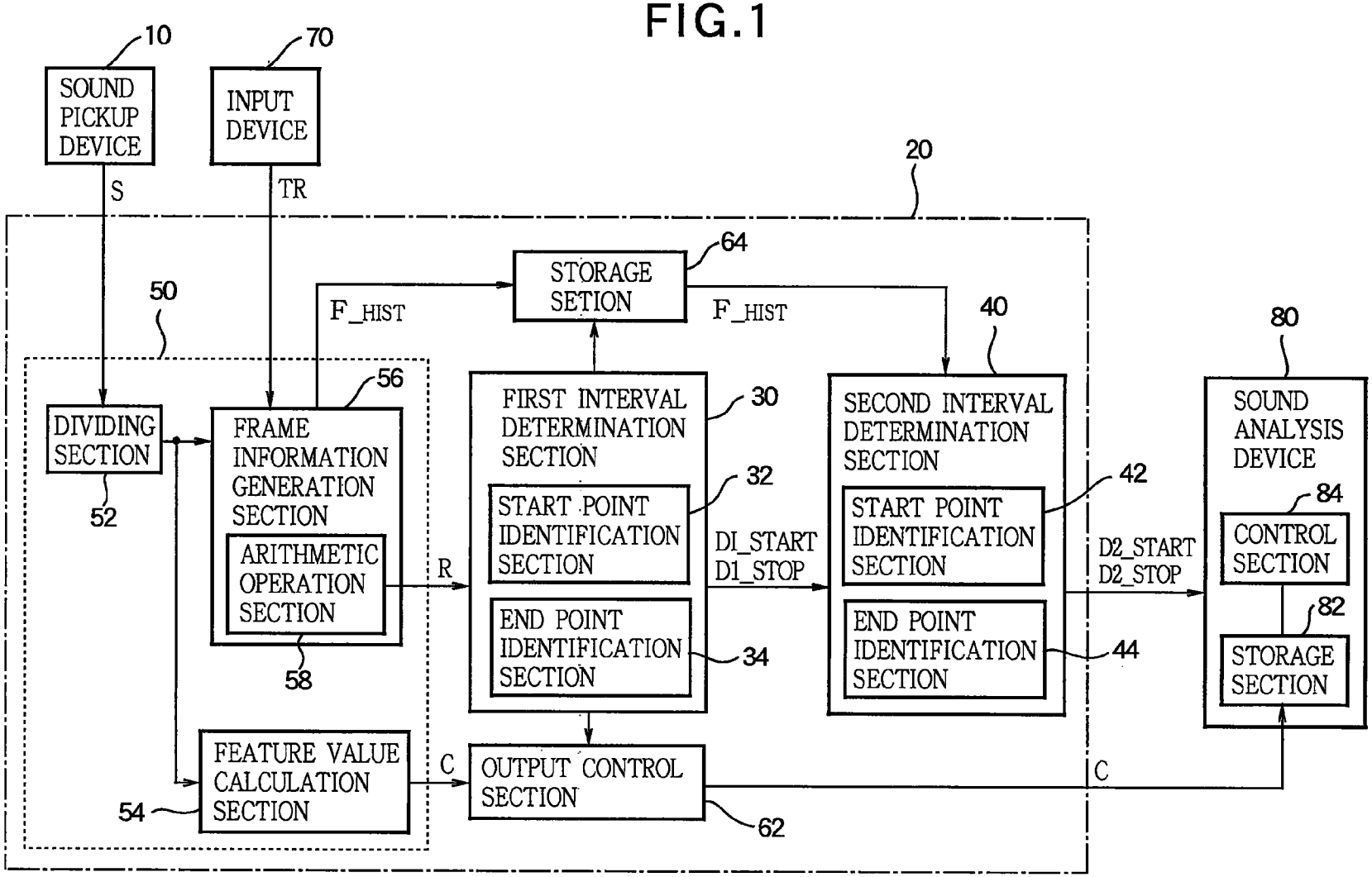
FIG. 1 is a block diagram showing the configuration of the sound signal processing system according to a first embodiment of the invention.

FIG. 1 is a block diagram showing the configuration of the sound signal processing system according to an embodiment of the invention. As shown in FIG. 1, the sound signal processing system includes a sound pickup device (microphone) 10, a sound signal processing apparatus 20, an input device 70, and a sound analysis device 80. Although this embodiment illustrates a configuration in which the sound pickup device 10, the input device 70, and the sound analysis device 80 are separate from the sound signal processing apparatus 20, part or all of the above components may form a single device.

Figure 2:
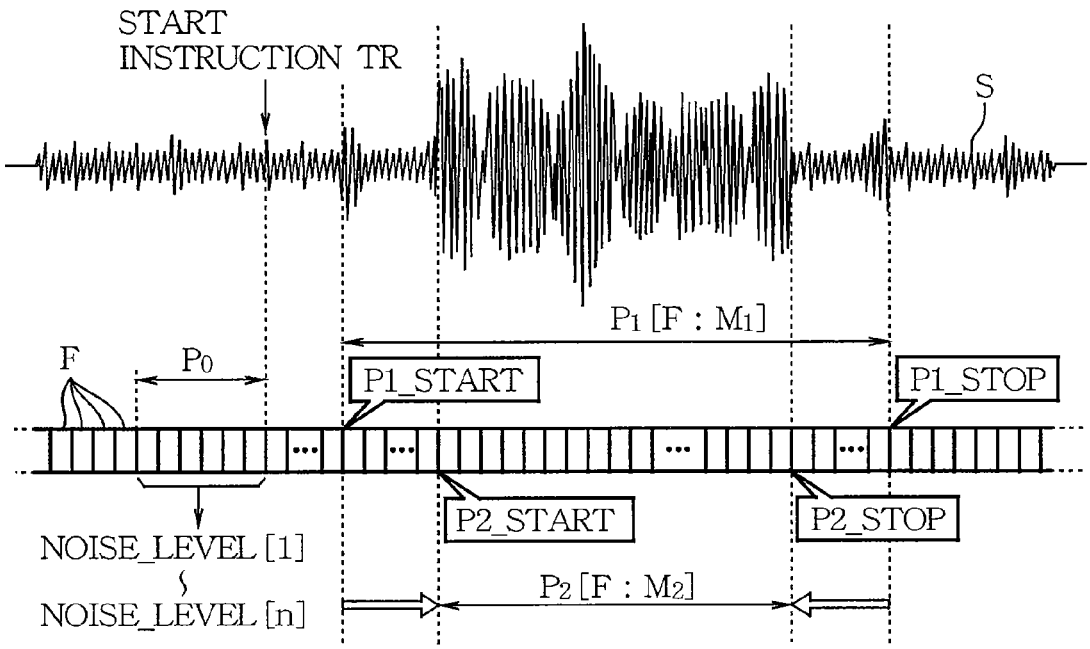
FIG. 2 is a conceptual view showing the relationship between a sound signal and first and second utterance intervals.

The sound pickup device 10 generates a sound signal S indicative of the waveform of surrounding sounds (voice and noise). FIG. 2 illustrates the waveform of the sound signal S. The sound signal processing apparatus 20 identifies an utterance interval in which the speaker has actually spoken in the sound signal S produced by the sound pickup device 10. The input device 70 is a keyboard or a mouse, for example that outputs a signal in response to the operation of a user. The user operates the input device 70 as appropriate to input an instruction (hereinafter referred to as "start instruction") TR that triggers the sound signal processing apparatus 20 to start detecting and identifying the utterance interval. The sound analysis device 80 is used to analyze the sound signal S. The sound analysis device 80 in this embodiment is a voice authentication device that verifies the authenticity of the speaker by comparing the feature value extracted from the sound signal S with the feature value registered in advance.

The sound signal processing apparatus 20 includes a first interval determination section 30, a second interval determination section 40, a frame analysis section 50, an output control section 62, and a storage section 64. The first interval determination section 30, the second interval determination section 40, the frame analysis section 50, and the output control section 62 may be embodied by a program executed by an arithmetic processing unit, such as a CPU, or may be embodied by a hardware circuit, such as a DSP.

The first interval determination section 30 is means for determining the first utterance interval P1 shown in FIG. 2 based on the sound signal S. On the other hand, the second interval determination section 40 is means for determining the second utterance interval P2 shown in FIG. 2. The method by which the first interval determination section 30 identifies the first utterance interval P1 differs from the method by which the second interval determination section 40 identifies the second utterance interval P2. The second interval determination section 40 in this embodiment identifies the utterance interval P2 by using a more accurate method than the method that the first interval determination section 30 uses to identify the utterance interval P1. The second utterance interval P2 is therefore shorter than the first utterance interval P1, and is confined within the first utterance interval P1, as shown in FIG. 2.

The frame analysis section 50 in FIG. 1 includes a dividing section 52, a feature value calculation section 54, and a frame information generation section 56. The dividing section 52 segments the sound signal S supplied from the sound pickup device 10 into frames, each having a predetermined time length (several tens of milliseconds, for example), and sequentially outputs the frames, as shown in FIG. 2. The frames are set in such a way that they overlap with one another on the temporal axis.

The feature value calculation section 54 calculates the feature value C for each frame F in the sound signal S. The feature value C is a parameter that the sound analysis device 80 uses to analyze the sound signal S. The feature value calculation section 54 in this embodiment uses frequency analysis including FFT (Fast Fourier Transform) processing to calculate a Mel Cepstrum coefficient (MFCC: Mel Frequency Cepstrum Coefficient) as the feature value C. The feature value C is calculated in real time in synchronization with the supply of the sound signal S in each frame F (that is, sequentially calculated whenever each frame in the sound signal S is supplied).

The frame information generation section 56 generates frame information F_HIST on each frame F in the sound signal S that is outputted from the dividing section 52. The frame information generation section 56 in this embodiment includes an arithmetic operation section 58 that calculates the S/N ratio R for each frame F. The S/N ratio R is the information that the first interval determination section 30 uses to identify the rough utterance interval P1. On the other hand, the frame information F_HIST is the information that the second interval determination section 40 uses to trim the rough utterance interval P1 into the fine or precise utterance interval P2. The frame information F_HIST and the S/N ratio R are calculated in real time in synchronization with the supply of the sound signal S for each frame F.

Figure 3:
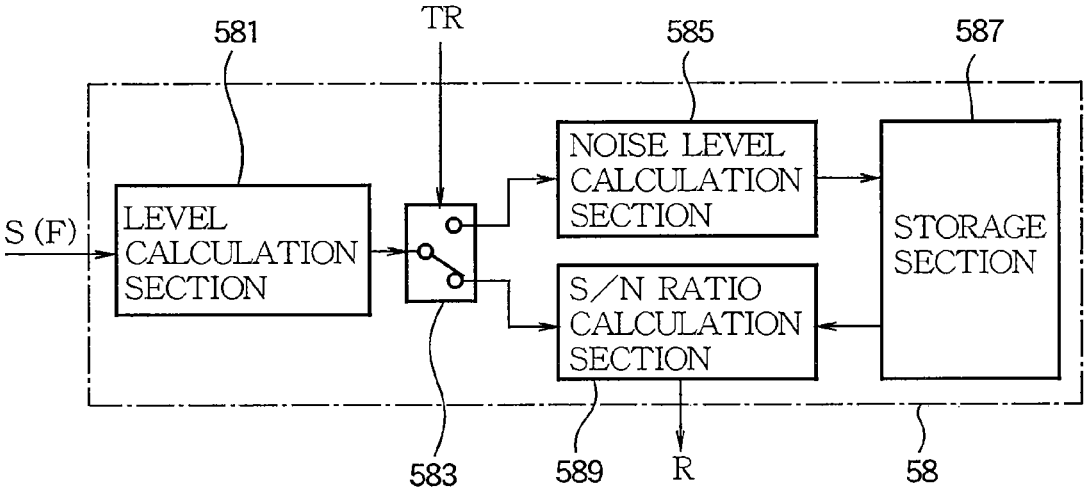
FIG. 3 is a block diagram showing the specific configuration of an arithmetic operation section.

FIG. 3 is a block diagram showing the specific configuration of the arithmetic operation section 58. As shown in FIG. 3, the arithmetic operation section 58 includes a level calculation section 581, a switching section 583, a noise level calculation section 585, a storage section 587, and an S/N ratio calculation section 589. The level calculation section 581 is means for sequentially calculating the level (magnitude) for each frame F in the sound signal S supplied from the dividing section 52. The level calculation section 581 in this embodiment segments the sound signal S of one frame F into n frequency bands (n is a natural number greater than or equal to two) and calculates band-basis levels FRAME_LEVEL[1] to FRAME_LEVEL[n], which are the levels of the frequency band components. Therefore, the level calculation section 581 is embodied, for example, by a plurality of bandpass filters (filter bank), the transmission bands of which are different from one another. Alternatively, the level calculation section 581 may be configured in such a way that frequency analysis, such as FFT processing, is used to calculate the band-basis levels FRAME_LEVEL[1] to FRAME_LEVEL [n].

The frame information generation section 56 in FIG. 1 calculates a signal level HIST_LEVEL for each frame F in the sound signal S. The frame information F_HIST on one frame F includes the signal level HIST_LEVEL calculated for that frame F. The signal level HIST_LEVEL is the sum of the band-basis levels FRAME_LEVEL[1] to FRAME_LEVEL [n], as expressed by the following equation (1). The frame information F_HIST on one frame F has a less amount of data than the feature value C (MFCC, for example) for the one frame F.

[Equation 1]

$$\text{HIST_LEVEL} = \sum_{i=1}^{n} \text{FRAME_LEVEL}[i] \tag{1}$$

The switching section 583 in FIG. 3 is means for selectively switching between different destinations to which the band-basis levels FRAME_LEVEL[1] through FRAME_LEVEL[n] calculated by the level calculation section 581 are supplied in response to the start instruction TR inputted from the input device 70. More specifically, the switching section 583 outputs the band-basis levels FRAME_LEVEL [1] to FRAME_LEVEL[n] to the noise level calculation section 585 before the start instruction TR is acquired, while outputting the band-basis levels to the S/N ratio calculation section 589 after the start instruction TR has been acquired.

The noise calculation section 585 is means for calculating noise levels NOISE_LEVEL[1] to NOISE_LEVEL[n] in a period P0 immediately before the switching section 583 acquires the start instruction TR as shown in FIG. 2. The period P0 ends at the point of the start instruction TR, and includes a plurality of frames F (six in the example shown in FIG. 2). The noise level NOISE_LEVEL[i] corresponding to the i-th frequency band is the mean value of the band-basis levels FRAME_LEVEL[i] over the predetermined number of frames F in the period P0. The noise levels NOISE_LEVEL [1] to NOISE_LEVEL[n] calculated by the noise level calculation section 585 are sequentially stored in the storage section 587.

The S/N ratio calculation section 589 in FIG. 3 calculates the S/N ratio R for each frame F in the sound signal S and outputs it to the first interval determination section 30. The S/N ratio R is a value corresponding to the relative ratio of the magnitude of each frame F after the start instruction TR to the magnitude of noise in the period P0. The S/N ratio calculation section 589 in this embodiment calculates the S/N ratio R based on the following equation (2) using the band-basis levels FRAME_LEVEL[1] to FRAME_LEVEL[n] of each frame F supplied from the switching section 583 after the start instruction TR and the noise levels NOISE_LEVEL[1] to NOISE_LEVEL[n] stored in the storage section 587.

[Equation 2]

$$R = \sum_{i=1}^{n} \frac{\text{FRAME_LEVEL}[i]}{\text{NOIZE_LEVEL}[i]} \tag{2}$$

The S/N ratio R calculated by using the above equation (2) is an index indicative of how much greater or smaller the current voice level is than the noise level present in the surroundings of the sound pickup device 10. That is, when the user is not speaking, the S/N ratio R has a value close to "1". The S/N ratio R increases over "1" as the magnitude of sound spoken by the user increases. The first interval determination section 30 roughly identifies the utterance interval P1 in FIG. 2 based on the S/N ratio R in each frame F. That is, roughly speaking, a sequence of frames F in which the S/N ratio R is greater than a predetermined value is identified as the utterance interval P1. In this embodiment, since the S/N ratio R is calculated based on the noise level of a predetermined number of frames F immediately before the start instruction TR (that is, immediately before the speaker speaks), the influence of the surrounding noise can be reduced in identifying the utterance interval P1.

As shown in FIG. 1, the first interval determination section 30 includes a start point identification section 32 and an end point identification section 34. The start point identification section 32 identifies the start point P1_START in the utterance interval P1 (FIG. 2) and generates start point data D1_START for discriminating the start point P1_START. The end point identification section 34 identifies the end point P1_STOP in the utterance interval P1 (FIG. 2) and generates end point data D1_STOP for discriminating the end point P1_STOP. The start point data DL_START is the number assigned to the first or top frame F in the utterance interval P1, and the end point data D1_STOP is the number assigned to the last frame F in the utterance interval P1. As shown in FIG. 2, the utterance interval P1 contains M1 (M1 is a natural number) frames F. A specific example of the operation of the first interval determination section 30 will be described later.

The storage section 64 is means for storing the frame information F_HIST generated by the frame information generation section 56. Various storage devices, such as semiconductor storage devices, magnetic storage device, and optical disc storage devices, are preferably employed as the storage section 64. The storage section 64 and the storage section 587 may be separate storage areas defined in one storage device, or may be individual storage devices.

The storage section 64 in this embodiment exclusively stores only the frame information F_HIST of the M1 frames F that belong to the utterance interval P1 among many pieces of frame information F_HIST sequentially calculated by the frame information generation section 56. That is, the storage section 64 starts storing the frame information F_HIST from the top frame F corresponding to the start point P1_START when the start point identification section 32 identifies the start point P1_START, and stops storing the frame information F_HIST at the last frame F corresponding to the end point P1_STOP when the end point identification section 34 identifies the end point P1_STOP.

The second interval determination section 40 identifies the utterance interval P2 in FIG. 2 based on the M1 pieces of frame information F_HIST (signal levels HIST_LEVEL) stored in the storage section 64. As shown in FIG. 1, the second interval determination section 40 includes a start point identification section 42 and an endpoint identification section 44. As shown in FIG. 2, the start point identification section 42 identifies the point when a time length (a number of frames) determined according to the above frame information F_HIST has passed from the start point P1_START in the utterance interval P1 as a start point P2_START in the utterance interval P2, and generates start point data D2_START for discriminating the start point P2_START. The end point identification section 44 identifies the point upstream from the end point P1_STOP in the utterance interval P1 by a time length (a number of frames) determined according to the above frame information F_HIST as an end point P2_STOP in the utterance interval P2, and generates end point data D2_STOP for discriminating the end point P2_STOP. The start point data D2_START is the number of the top frame F in the utterance interval P2, and the end point data D2_STOP is the number of the last frame F in the utterance interval P2. The start point data D2_START and the end point data D2_STOP are outputted to the sound analysis device 80. As shown in FIG. 2, the utterance interval P2 contains M2 (M2 is a natural number) frames F (M2<M1). A specific example of the operation of the second interval determination section 40 will be described later.

The output control section 62 in FIG. 1 is means for selectively outputting the feature value C, sequentially calculated by the feature value calculation section 54 for each frame F, to the sound analysis device 80. The output control section 62 in this embodiment outputs the feature value C for each frame F that belongs to the utterance interval P1 to the sound analysis device 80, while discarding the feature value C for each frame F other than the frames in the utterance interval P1 (no output to the sound analysis device 80). That is, the output control section 62 starts outputting the feature value C from the frame F corresponding to the start point P1_START when the start point identification section 32 identifies the start point P1_START, and outputs the feature value C for each of the following frames F in real time in synchronization with the calculation performed by the feature value calculation section 54. (That is, whenever the feature value calculation section 54 supplies the feature value C for each frame F, the feature value C is outputted to the sound analysis device 80.) Then, the output control section 62 stops outputting the feature value C at the last frame F corresponding to the end point P1_STOP when the end point identification section 34 identifies the end point P1_STOP.

As shown in FIG. 1, the sound analysis device 80 includes a storage section 82 and a control section 84. The storage section 82 stores in advance a group of feature values C extracted from the voice of a specific speaker (hereinafter referred to as "registered feature values"). The storage section 82 also stores the feature values C outputted from the output control section 62. That is, the storage section 82 stores the feature value C for each of M1 frames F that belong to the utterance interval P1.

The start point data D2_START and the end point data D2_STOP generated by the second interval determination section 40 are supplied to the control section 84. The control section 84 uses M2 feature values C in the utterance interval P2 defined by the start point data D2_START and the end point data D2_STOP among the M1 feature values C stored in the storage section 82 to analyze the sound signal S. For example, the control section 84 uses various pattern matching technologies, such as DP matching, to calculate the distance (similarity) between each feature value C in the utterance interval P2 and each of the registered feature values, and judges the authenticity of the current speaker based on the calculated distances (whether or not the speaker is an authorized user registered in advance).

As described above, in this embodiment, since the feature value C of each frame F is outputted to the sound analysis device 80 in real time concurrently with the identification process of the utterance interval P1, the sound signal processing apparatus 20 does not need to hold the feature values C for all the frames F in the utterance interval P1 until the utterance interval P1 is determined (the end point P1_STOP is determined). It is therefore possible to reduce the scale of the sound signal processing apparatus 20. Furthermore, since each feature value C in the utterance interval P2, which is made narrower than the utterance interval P1, is used to analyze the sound signal S in the sound analysis device 80, there are provided advantages of reduction in processing load on the control section 84 and improvement in accuracy of the analysis (for example, the accuracy in authentication of the speaker), as compared to a configuration in which the analysis of the sound signal S is carried out on all feature values C in the utterance interval P1.

A-2: Operation

A specific operation of the sound signal processing apparatus 20 will be described primarily with reference to the processes of identifying the utterance interval P1 and the utterance interval P2.

Once the sound signal processing apparatus 20 is activated, the level calculation section 581 in FIG. 3 successively calculates the band-basis levels FRAME_LEVEL[1] to FRAME_LEVEL[n] for each frame F in the sound signal S. When the user inputs the start instruction TR from the input device 70 before the user speaks, the noise level calculation section 585 calculates the noise levels NOISE_LEVEL[1] to NOISE_LEVEL[n] from the band-basis levels FRAME_LEVEL[1] to FRAME_LEVEL[n] of a predetermined number of frames F immediately before the start instruction TR and stores them in the storage section 587. On the other hand, the S/N ratio calculation section 589 calculates the S/N ratio R of the band-basis levels FRAME_LEVEL[1] to FRAME_LEVEL[n] for each frame F after the start instruction TR to the noise levels NOISE. LEVEL[1] to NOISE_LEVEL[n] in the storage section 587.

(a) Operation of the First Interval Determination Section 30

Triggered by the start instruction TR, the first interval determination section 30 starts the process for determining the utterance interval P1. That is, the process in which the start point identification section 32 identifies the start point P1_START (FIG. 4) and the process in which the end point identification section 34 identifies the endpoint P1_STOP (FIG. 5) are carried out. Each of the processes is described below in detail.

Figure 4:
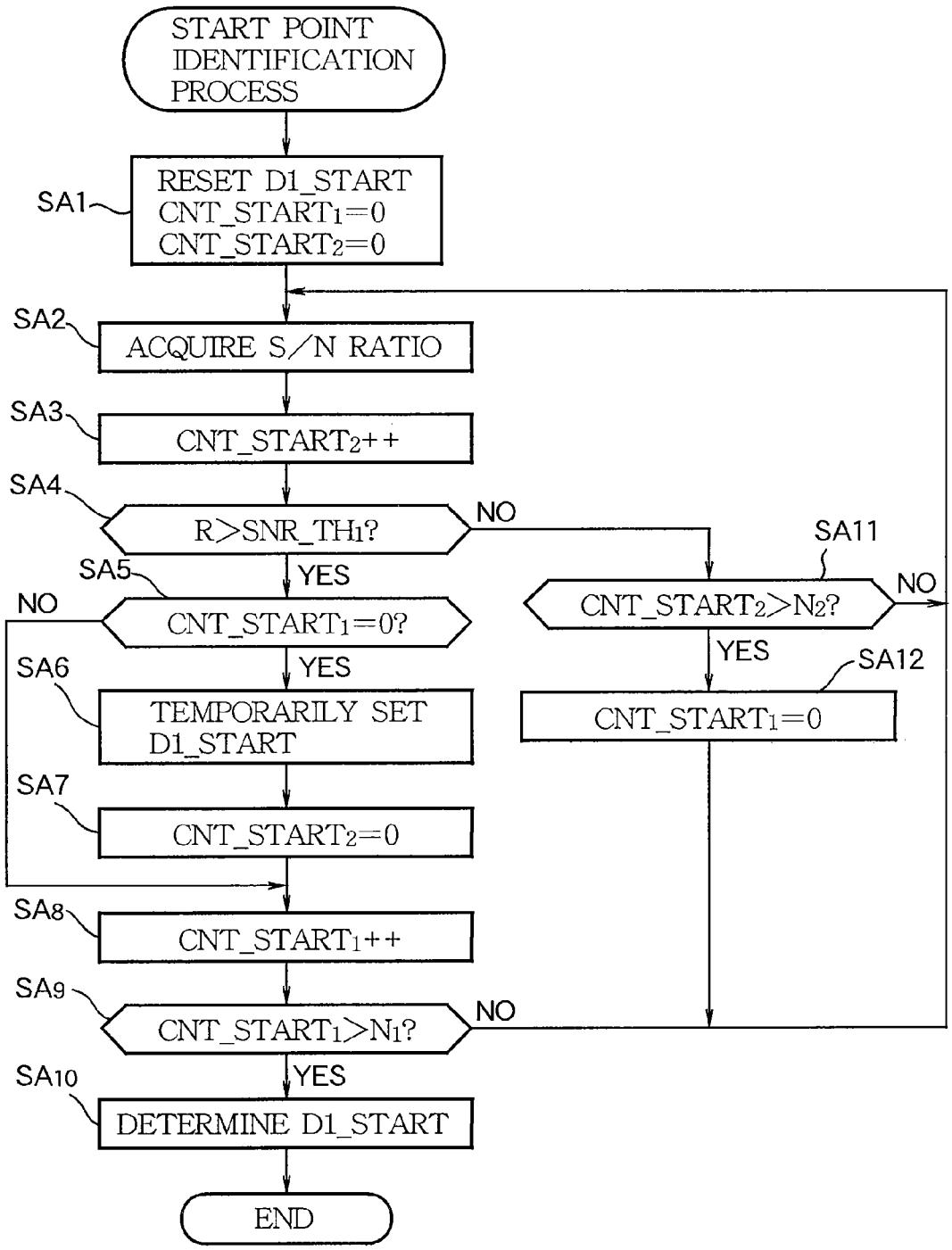
FIG. 4 is a flowchart showing processes of identifying the start point of the first utterance interval.

As shown in FIG. 4, the start point identification section 32 resets the start point data D1_START and initializes variables CNT_START1 and CNT_START2 to zero (step SA1). Then, the start point identification section 32 acquires the S/N ratio R of one frame F from the S/N ratio calculation section 589 (step SA2), and adds "1" to the variable CNT_START2 (step SA3).

Then, the start point identification section 32 judges whether or not the S/N ratio R acquired in the step SA2 is greater than a predetermined threshold value SNR_TH1 (step SA4). Although a frame F in which the S/N ratio R is greater than the threshold value SNR_TH1 is possibly a frame F in the utterance interval P1, the S/N ratio R may accidentally exceed the threshold value SNR_TH1 due to surrounding noise and electric noise in some cases. To address this problem, in this embodiment as described below, among a predetermined number of frames F beginning with the frame F in which the S/N ratio R first exceeds the threshold value SNR_TH1 (hereinafter referred to as "candidate frame group"), when the number of frames F in which the S/N ratio R is greater than the threshold value SNR_TH1 exceeds N1, the first frame F is identified as the start point P1_START in the utterance interval P1.

When the result of the step SA4 is YES, the start point identification section 32 judges whether or not the variable CNT_START1 is zero (step SA5). The fact that the variable CNT_START1 is zero means that the current frame F is the first frame F in the candidate frame group. Therefore, when the result of the step SA5 is YES, the start point identification section 32 temporarily sets the number of the current frame F to the start point data D1_START (step SA6), and initializes the variable CNT_START2 to zero (step SA7). That is, the current frame F is temporarily set to be the start point P1_START in the utterance interval P1. On the other hand, when the result of the step SA5 is NO, the start point identification section 32 moves the process to the step SA8 without executing the steps SA6 and SA7.

The start point identification section 32 adds "1" to the variable CNT_START1 (step SA8) and then judges whether or not the variable CNT_START1 after the addition is greater than the predetermined value N1 (step SA9). When the result of the step SA9 is YES, the start point identification section 32 determines the number of the frame F temporarily set in the preceding step SA6 as the approved start point data D1_START (step SA10). That is, the start point P1_START of the utterance interval P1 is identified. In the step SA10, the start point identification section 32 outputs the start point data D1_START to the second interval determination section 40, and notifies the output control section 62 and the storage section 64 of the determination of the start point P1_START. Triggered by the notification from the first interval determination section 30, the output control section 62 starts outputting the feature value C and the storage section 64 starts storing the frame information F_HIST.

When the result of the step SA9 is NO (that is, among the candidate frame group, when the number of frames F in which the S/N ratio R is greater than the threshold value SNR_TH1 is still N1 or smaller), the start point identification section 32 acquires the S/N ratio R for the next frame F (step SA2) and then executes the processes from the step SA3. As described above, the start point P1_START is not determined only by the fact that the S/N ratio R of one frame F is greater than the threshold value SNR_TH1, resulting in reduced possibility of misrecognizing increase in the S/N ratio R due to, for example, surrounding noise and electric noise as the start point P1_START in the utterance interval P1.

On the other hand, when the result of the step SA4 is NO (that is, when the S/N ratio R is smaller than or equal to the threshold value SNR_TH1), the start point identification section 32 judges whether or not the variable CNT_START2 is greater than a predetermined value N2 (step SA11). The fact that the variable CNT_START2 is greater than the predetermined value N2 means that among the N2 frames F in the candidate frame group, the number of frames F in which the S/N ratio R is greater than the threshold value SNR_TH1 is N1 or smaller. When the result of the step SA11 is YES, the start point identification section 32 initializes the variable CNT_START1 to zero (step SA12) and then moves the process to the step SA2. When the S/N ratio R exceeds the threshold value SNR_TH1 immediately after the step SA12 (step SA4: YES), the result of the step SA5 becomes YES, and the steps SA6 and SA7 are then executed. That is, the candidate frame group is updated in such a way that the frame F in which the S/N ratio R newly exceeds the threshold value SNR_TH1 becomes the start point of the updated candidate frame group. On the other hand, when the result of the step SA11 is NO, the start point identification section 32 moves the process to the step SA2 without executing the step SA12.

Figure 5:
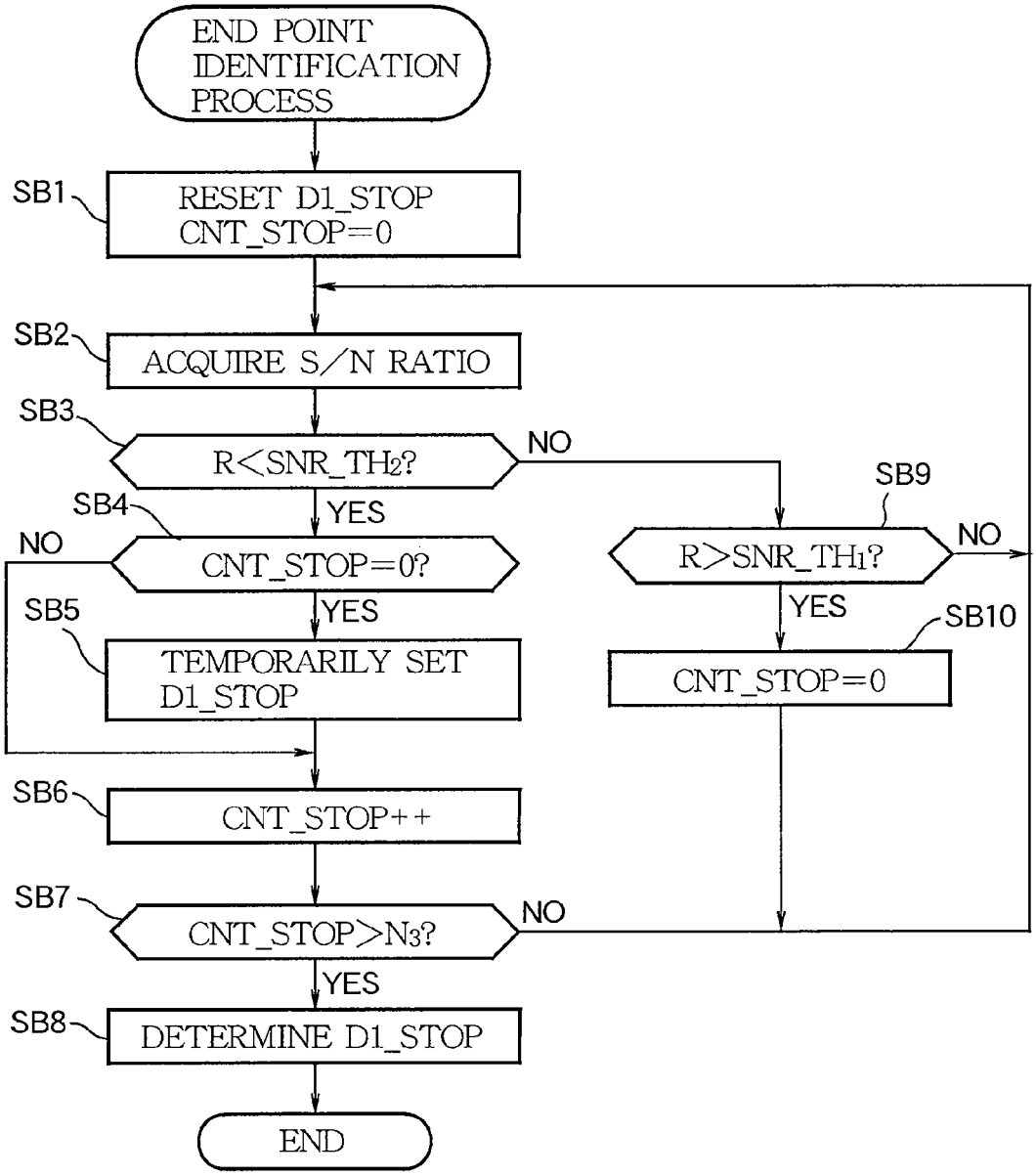
FIG. 5 is a flowchart showing processes of identifying the end point of the first utterance interval.

After the start point P1_START has been identified in the processes in FIG. 4, the end point identification section 34 carries out the processes of identifying the end point P1_STOP of the utterance interval P1 (FIG. 5). When the number of frames F in which the S/N ratio R is lower than a threshold value SNR_TH2 is greater than N3, the end point identification section 34 identifies the frame F in which the S/N ratio R first becomes lower than the threshold value SNR_TH2 as the end point P1_STOP.

As shown in FIG. 5, the end point identification section 34 resets the end point data DL_STOP, initializes a variable CNT_STOP to zero (step SB1), and then acquires the S/N ratio R from the S/N ratio calculation section 589 (step SB2). Then, the end point identification section 34 judges whether or not the S/N ratio R acquired in the step SB2 is lower than the predetermined threshold value SNR_TH2 (step SB3).

When the result of the step SB3 is YES, the end point identification section 34 judges whether or not the variable CNT_STOP is zero (step SB4). When the result of the step SB4 is YES, the end point identification section 34 temporarily sets the number of the current frame F to the end point data D1_STOP (step SB5). On the other hand, when the result of the step SB4 is NO, the end point identification section 34 moves the process to the step SB6 without executing the step SB5.

Then, the end point identification section 34 adds "1" to the variable CNT_STOP (step SB6), and then judges whether or not the variable CNT_STOP after the addition is greater than the predetermined value N3 (step SB7). When the result of the step SB7 is YES, the end point identification section 34 determines the number of the frame F temporarily set in the preceding step SB5 as the approved end point data D1_STOP (step SB8). That is, the end point P1_STOP of the utterance interval P1 is identified. In the step SB8, the end point identification section 34 outputs the end point data D1_STOP to the second interval determination section 40, and notifies the output control section 62 and the storage section 64 of the determination of the end point P1_STOP. Triggered by the notification from the first interval determination section 30, the output control section 62 stops outputting the feature value C and the storage section 64 stops storing the frame information F_HIST. Therefore, when the processes in FIG. 5 have been completed, for each of the M1 frames F that belong to the utterance interval P1, the storage section 64 has stored the frame information F_HIST (signal level HIST_LEVEL) and the storage section 84 in the sound analysis device 80 has stored the feature value C.

When the result of the step SB7 is NO (that is, when the number of frames F in which the S/N ratio R is lower than the threshold value SNR_TH2 is smaller than or equal to N3), the end point identification section 34 acquires the S/N ratio R for the next frame F (step SB2) and then executes the processes from the step SB3. As described above, the end point P1_STOP is not determined only by the fact that the S/N ratio R of one frame F becomes lower than the threshold value SNR_TH2, resulting in reduced possibility of misrecognition of the point when the S/N ratio R accidentally decreases as the end point P1_STOP.

On the other hand, when the result of the step SB3 is NO, the end point identification section 34 judges whether or not the current S/N ratio R is greater than the threshold value SNR_TH1 used to identify the start point P1_START (step SB9). When the result of the step SB9 is NO, the end point identification section 34 moves the process to the step SB2 to acquire a new S/N ratio R.

The S/N ratio R obtained when the user speaks is basically greater than the threshold value SNR_TH1. Therefore, when the S/N ratio R exceeds the threshold value SNR_TH1 after the processes in FIG. 5 are initiated (step SB9: YES), the user is possibly speaking. When the result of the step SB9 is YES, the end point identification section 34 initializes the variable CNT_STOP to zero (step SB10) and then executes the processes from the step SB2. When the S/N ratio R becomes lower than the threshold value SNR_TH2 after the step SB10 is executed (step SB3: YES), the result of the step SB4 becomes YES and the step SB5 is executed. That is, even when the S/N ratio R has become lower than the threshold value SNR_TH2 and the end point data DL_STOP has been temporarily set, the temporarily set end point data DL_STOP is cancelled when the number of frames F in which the S/N ratio R is lower than the threshold value SNR_TH2 is smaller than or equal to the predetermined value N3 and the S/N ratio R of one frame F exceeds the threshold value SNR_TH1 (that is, when the user is possibly speaking).

(b) Operation of the Second Interval Determination Section 40

To reliably detect the interval in which the speaker has actually spoken (that is, to reliably prevent such an interval from being undetected), it is necessary, for example, to set the threshold value SNR_TH1 in FIG. 4 to a relatively small value and set the threshold value SNR_TH2 in FIG. 5 to a relatively large value. Therefore, for example, when there are cough sound, lip noise, and sounds produced in the mouth before the speaker actually speaks, the point when such noise is produced may be recognized as the start point P1_START of the utterance interval P1 in some cases. To address this problem, after the first interval determination section 30 has identified the utterance interval P1, the second interval determination section 40 identifies the utterance interval P2 by sequentially eliminating frames F that possibly correspond to noise from the first and last frames F in the utterance interval P1 (that is, shortening the utterance interval P1).

Figure 6:
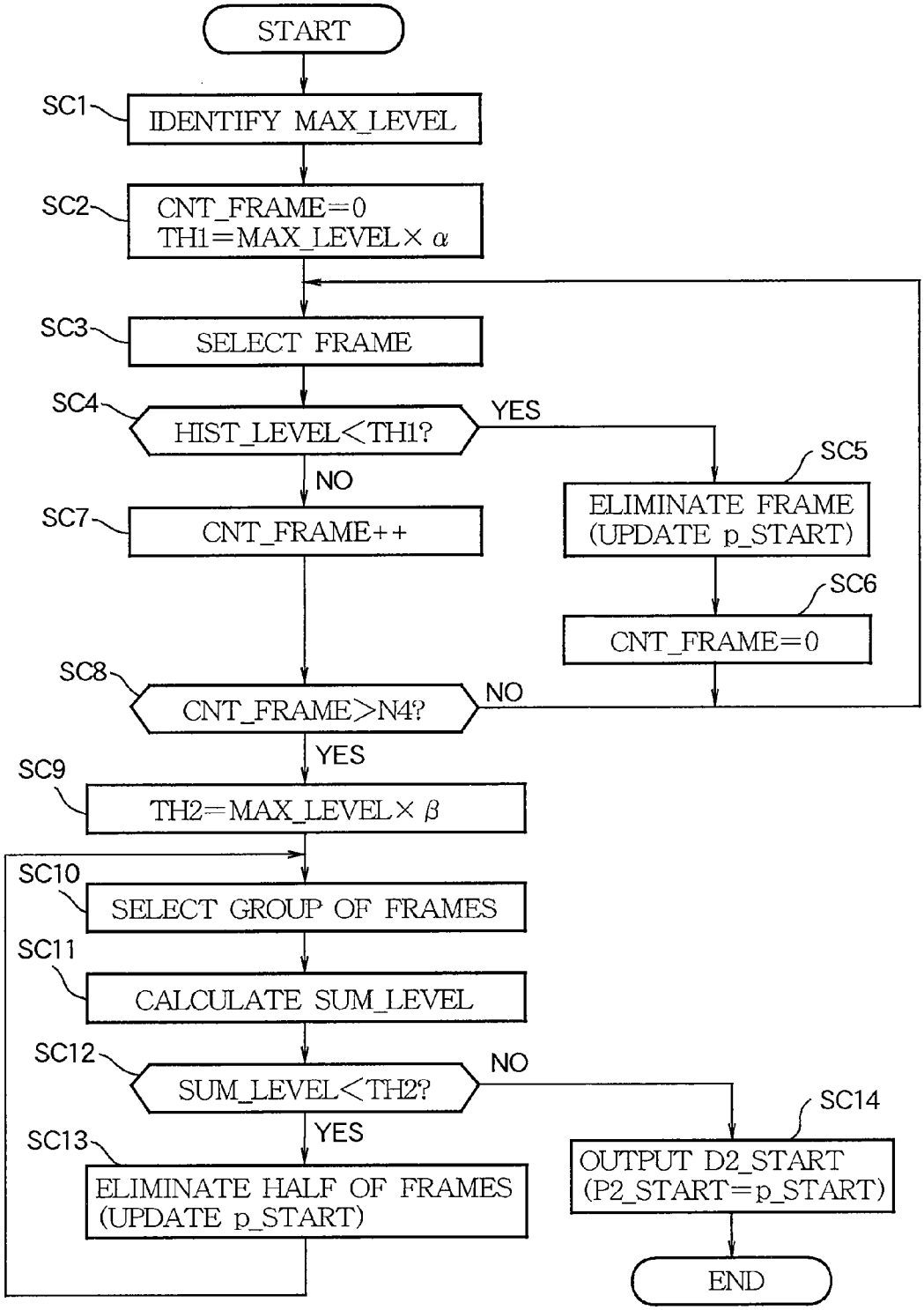
FIG. 6 is a flowchart showing processes of identifying the second utterance interval.

FIG. 6 is a flowchart showing the contents of the processes performed by the start point identification section 42 in the second interval determination section 40. The start point identification section 42 in the second interval determination section 40 identifies the maximum value MAX_LEVEL of the signal levels HIST_LEVEL among M1 pieces of frame information F_HIST stored in the storage section 64 (step SC1). Then, the start point identification section 42 initializes a variable CNT_FRAME to zero and sets a threshold value TH1 according to the maximum value MAX_LEVEL (step SC2). The threshold value TH1 in this embodiment is the value obtained by multiplying the maximum value MAX_LEVEL identified in the step SC1 by a coefficient $\alpha$. The coefficient $\alpha$ is a preset value smaller than "1".

Then, the start point identification section 42 selects one frame F from the M1 frames F in the utterance interval P1 (step SC3). The start point identification section 42 in this embodiment sequentially selects each frame F in the utterance interval P1 from the first frame toward the last frame for each step SC3. That is, in the first step SC3 after the processes in FIG. 6 have been initiated, the first frame F in the utterance interval P1 is selected, and in the following steps SC3, the frame F immediately after the frame F selected in the preceding step SC3 is selected.

Then, the start point identification section 42 judges whether or not the signal level HIST_LEVEL in the frame information F_HIST corresponding to the frame F selected in the step SC3 is lower than the threshold value TH1 (step SC4) Since the noise level is smaller than the maximum value MAX_LEVEL, the frame F in which the signal level HIST_LEVEL is lower than the threshold value TH1 is possibly noise that has been produced immediately before the actual speech. When the result of the step SC4 is YES, the start point identification section 42 eliminates the frame F selected in the step SC3 from the utterance interval P1 (step SC5). In more detail, the start point identification section 42 selects the frame F immediately after the frame F selected in the step SC3 as a temporary start point p_START. Then, the start point identification section 42 initializes the variable CNT_FRAME to zero (step SC6) and then moves the process to the step SC3. In the step SC3, the frame F immediately after the currently selected frame F is newly selected.

When the result of the step SC4 is NO (that is, when the signal level HIST_LEVEL is greater than or equal to the threshold value TH1), the start point identification section 42 adds "1" to the variable CNT_FRAME (step SC7) and then judges whether or not the variable CNT_FRAME after the addition is greater than a predetermined value N4 (step SC8). When the result of the step SC8 is NO, the start point identification section 42 moves the process to the step SC3 and selects a new frame F. On the other hand, when the result of the step SC8 is YES, the start point identification section 42 moves the process to the step SC9. That is, when the result of the step SC4 is successively NO (HIST_LEVEL<TH1) for more than N4 frames, the process proceeds to the step SC9.

In the step SC9, the start point identification section 42 sets a threshold value TH2 according to the maximum value MAX_LEVEL identified in the step SC1. The threshold value TH2 in this embodiment is the value obtained by multiplying the maximum value MAX_LEVEL by a preset coefficient $\beta$.

Figure 7:
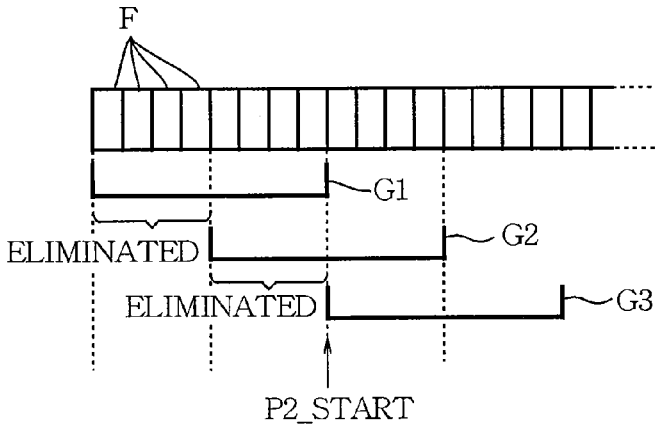
FIG. 7 is a conceptual view for explaining the processes of identifying the second utterance interval.

Then, the start point identification section 42 selects a predetermined number of successive frames F from the plurality of frames F after the current temporary start point p_START in the utterance interval P1 (that is, when the step SC5 has been executed several times, the utterance interval P1 with several frames F on the start point side eliminated) (step SC10). FIG. 7 is a conceptual view showing groups G (G1, G2, G3, . . . ) formed of frames F selected in the step SC10. As shown in FIG. 7, in the first step SC10 after the processes in FIG. 6 have been initiated, the group G1 formed of a predetermined number of first frames F is selected.

Then, the start point identification section 42 calculates the sum SUM_LEVEL for the signal levels HIST_LEVEL in the predetermined number of frames F selected in the step SC10 (step SC11). The start point identification section 42 judges whether or not the sum SUM_LEVEL calculated in the step SC11 is lower than the threshold value TH2 calculated in the step SC9 (step SC12).

As described with reference to FIG. 4, in this embodiment, when in the candidate frame group, the number of frames F in which the S/N ratio R is greater than the threshold value SNR_TH1 is greater than N1, the first frame F is identified as the start point P1_START in the utterance interval P1. Therefore, when noise is produced for a plurality of frames F in the candidate frame group, the first frame in the candidate frame group can be recognized as the start point P1_START. On the other hand, since the noise level is sufficiently smaller than the maximum value MAX_LEVEL, the frames F in which the sum SUM_LEVEL of the signal levels HIST_LEVEL for the predetermined number of frames F is lower than the threshold value TH2 are possibly noise produced immediately before actual pronunciation.

When the result of the step SC12 is YES, the start point identification section 42 eliminates the first half of the frames F from the group G selected in the step SC10 (step SC13), as shown in FIG. 7. That is, the first frame F in the last in the divided group G is selected as a temporary start point p_START. Then, the start point identification section 42 moves the process to the step SC10, selects the group G2 formed of the predetermined number of current first frames F, and executes the processes from the step SC11, as shown in FIG. 7.

On the other hand, when the result of the step SC12 is NO, the start point identification section 42 determines the current start point p_START as the start point P2_START, and outputs the start point data D2_START that specifies the start point P2_START (frame number) to the sound analysis device 80 (step SC14). For example, as shown in FIG. 7, when the group G3 is selected and the result of the step SC12 is NO, the first frame of the group G3 (the first frame in the last half of the group G2) is identified as the start point P2_START.

The end point identification section 44 in the second interval determination section 40 identifies the end point P2_STOP by sequentially eliminating each frame F in the utterance interval P1 from the last frame through processes similar to those in FIG. 6. That is, the end point identification section 44 sequentially selects each frame F in the utterance interval P1 from the last frame toward the first frame for each step SC3, and eliminates the selected frame F when the signal level HIST_LEVEL is lower than the threshold value TH1 (step SC5). The end point identification section 44 selects a group G formed of a predetermined successive frames F from the last frame toward the first frame (step SC10), and calculates the sum SUM_LEVEL of the signal levels HIST_LEVEL (step SC11). Then, the end point identification section 44 eliminates the last half of the frames F in the group G when the sum SUM_LEVEL is lower than the threshold value TH2 (step SC13), while outputting the end point data D2_STOP that specifies the current last frame F as the end point P2_STOP in the utterance interval P2 to the sound analysis device 80 when the sum SUM_LEVEL is greater than the threshold value TH2 (step SC14).

As described above, at the point when the second interval determination section 40 identifies the utterance interval P2, the maximum value MAX_LEVEL of the signal levels HIST_LEVEL in the utterance interval P1 has been determined. Therefore, by using the maximum value MAX_LEVEL as illustrated above, the second interval determination section 40 can identify the utterance interval P2 in a more accurate manner than the first interval determination section 30, which needs to identify the utterance interval P1 at the point when the maximum value MAX_LEVEL has not been determined. That is, frames F contained in the utterance interval P1 due to cough sound, lip noise, and the like produced by the speaker are eliminated by the second interval determination section 40. Therefore, in the sound analysis device 80, each frame F in the utterance interval P2 without noise influence can be used to analyze the sound signal S in a highly accurate manner.

Although the above embodiment illustrates the configuration in which the signal level HIST_LEVEL is used as the frame information F_HIST, the contents of the frame information F_HIST are changed as appropriate. For example, the signal level HIST_LEVEL in the above operation may be replaced with the S/N ratio R calculated for each frame F by the S/N ratio calculation section 589. That is, the frame information F_HIST that the second interval determination section 40 uses to identify the utterance interval P2 may have any specific contents as long as they are values according to the signal level of the sound signal S (signal index values).

B: Second Embodiment

A second embodiment of the invention will be described below. The elements in this embodiment that are common to those in the first embodiment in terms of action and function have the same reference characters as those in the first embodiment, and detailed description thereof will be omitted as appropriate.

When outside wind or breathe from the speaker's nose blows the sound pickup device 10 (that is, when wind noise is picked up), the sound signal S maintains a high level for a long period of time. Therefore, the first interval determination section 30 may recognize the period containing the wind noise as the utterance interval P1 although the speaker has not actually spoken in that period. To address the problem, the second interval determination section 40 in this embodiment identifies the utterance interval P2 by eliminating frames possibly containing wind noise from the utterance interval P1.

The frame information generation section 56 in this embodiment detects the pitch of the sound signal S for each frame F therein, and generates pitch data HIST_PITCH indicative of the detection result. The frame information F_HIST stored in the storage section 64 contains the pitch data HIST_PITCH as well as a signal level HIST_LEVEL similar to that in the first embodiment. When a clear pitch is detected for a frame F in the sound signal S, the pitch data HIST_PITCH represents the pitch, while when no clear pitch is detected for the sound signal S, the pitch data HIST_PITCH represents the fact that no pitch has been detected (the pitch data HIST_PITCH is set to zero, for example). Since a pitch can be basically detected for human voice having a high level, pitch data HIST_PITCH containing that pitch is generated. In contrast, since no clear pitch is detected for wind noise having no regular harmonic structure, pitch data HIST_PITCH indicating that no pitch has been detected is generated when wind noise has been picked up.

Figure 8:
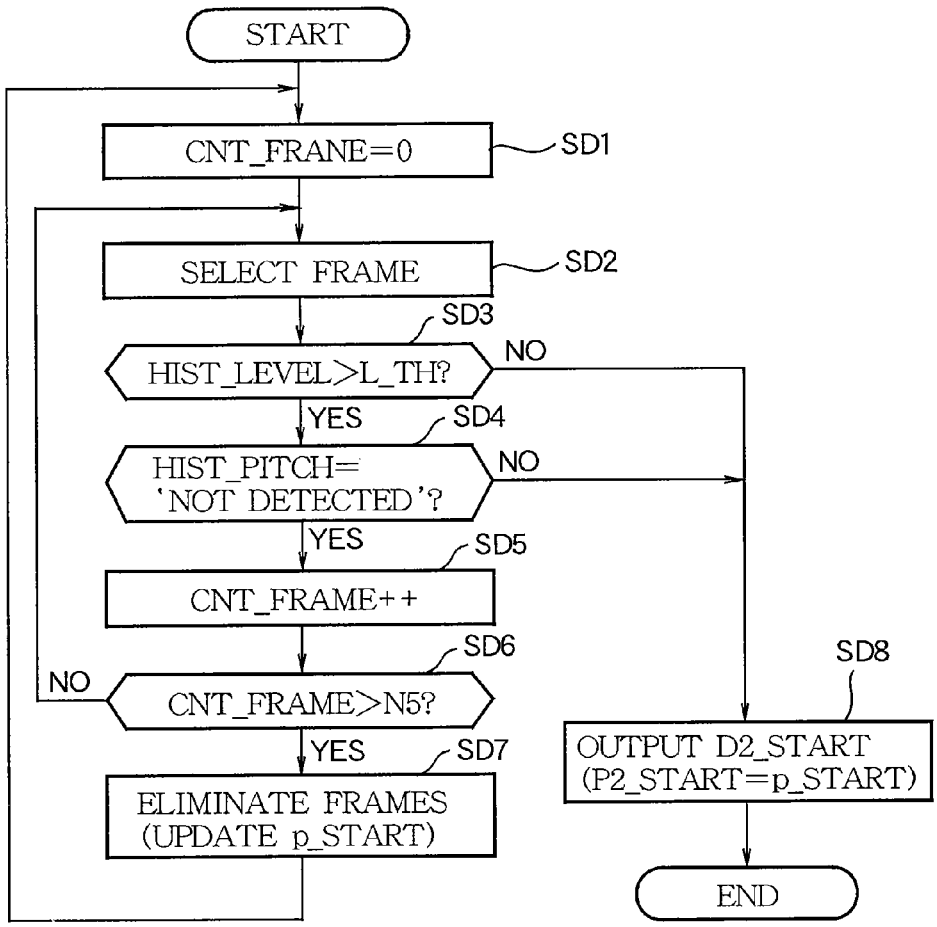
FIG. 8 is a flowchart showing processes of identifying the second utterance interval in a second embodiment.

FIG. 8 is a flowchart showing the operation of the start point identification section 42 in the second interval determination section 40. The start point identification section 42 initializes the variable CNT_FRAME to zero (step SD1) and then selects one frame F in the utterance interval P1 (step SD2). Each frame F is sequentially selected for each step SD2 from the first frame toward the last frame in the utterance interval P1. Then, the start point identification section 42 judges whether or not the signal level HIST_LEVEL contained in the frame information F_HIST on the frame F selected in the step SD2 is greater than a predetermined threshold value L_TH (step SD3).

When the result of the step SD3 is YES, the start point identification section 42 judges whether or not the pitch data HIST_PITCH contained in the frame information F_HIST on the frame F selected in the step SD2 indicates that no pitch has been detected (step SD4). When the result of the step SD4 is YES, the start point identification section 42 adds "1" to the variable CNT_FRAME (step SD5), and then judges whether or not the variable CNT_FRAME after the addition is greater than a predetermined value N5 (step SD6). When only wind noise has been picked up, the sound signal S continuously maintains a high level and indicates that no pitch has been detected for a plurality of frames F. When the result of the step SD6 is YES (that is, when the results of the steps SD3 and SD4 are successively YES for more than N5 frames F), the start point identification section 42 eliminates a predetermined number (N5+1) of frames F preceding the currently selected frame F (step SD7), and moves the process to the step SD1. That is, the start point identification section 42 selects the frame F immediately after the frame F selected in the preceding step SD2 as the temporary start point p_START. On the other hand, when the result of the step SD6 is NO (when the successive number of frames F that satisfy the conditions of the steps SD3 and SD4 is N5 or smaller), the start point identification section 42 moves the process to the step SD2, selects a new frame F, and then executes the processes from the step SD3.

On the other hand, when the result of any of the steps SD3 and SD4 is NO (that is, when the voice in the frame F is less likely only wind noise), the current first frame F is selected as the start point P2_START. That is, the start point identification section 42 determines the temporary start point p_START as the start point P2_START, and outputs the start point data D2_START that specifies the start point P2_START to the sound analysis device 80 (step SD8).

The end point identification section 44 in the second interval determination section 40 identifies the end point P2_STOP by sequentially eliminating each frame F in the utterance interval P1 from the last frame using processes similar to those in FIG. 8. That is, the end point identification section 44 sequentially selects each frame F in the utterance interval P1 from the last frame toward the first frame for each step SD2, and, in the step SD7, eliminates a predetermined number of frames F that have been successively judged to be YES in the steps SD3 and SD4. Then, in the step SD8, the end point data D2_STOP that specifies the current last frame F as the end point P2_STOP is generated. According to the above embodiment, the frame F recognized as part of the utterance interval P1 due to the influence of wind noise is eliminated. Therefore, the accuracy of the analysis of the sound signal S performed by the sound analysis device 80 can be improved.

C: Third Embodiment

A third embodiment of the invention will be described below. The elements in this embodiment that are common to those in the first embodiment in terms of action and function have the same reference characters as those in the first embodiment, and detailed description thereof will be omitted as appropriate.

The sound analysis device 80 authenticates the speaker by comparing the registered feature value that has been extracted when the authorized user has spoken a specific word (password) with the feature value C extracted from the sound signal S. To maintain the accuracy of authentication, it is desirable that the time length of the last phoneme of the password during authentication is substantially the same as that during registration. In practice, however, the time length of the unvoiced consonant corresponding to the end of the password varies whenever authentication is carried out. To address this problem, in this embodiment, a plurality of successive frames F upstream from the end point P1_STOP in the utterance interval P1 are eliminated in such a way that the unvoiced consonant at the end of the password always has a predetermined time length during authentication.

The frame information generation section 56 in this embodiment generates a zero-cross number HIST_ZXCNT for the sound signal S in each frame F as the frame information F_HIST. The zero-cross number HIST_ZXCNT is the count incremented whenever the level of the sound signal S in one frame F varies and exceeds a reference value (zero). When the voice picked up by the sound pickup device 10 is an unvoiced consonant, the zero-cross number HIST_ZXCNT in each frame F becomes a large value.

Figure 9:
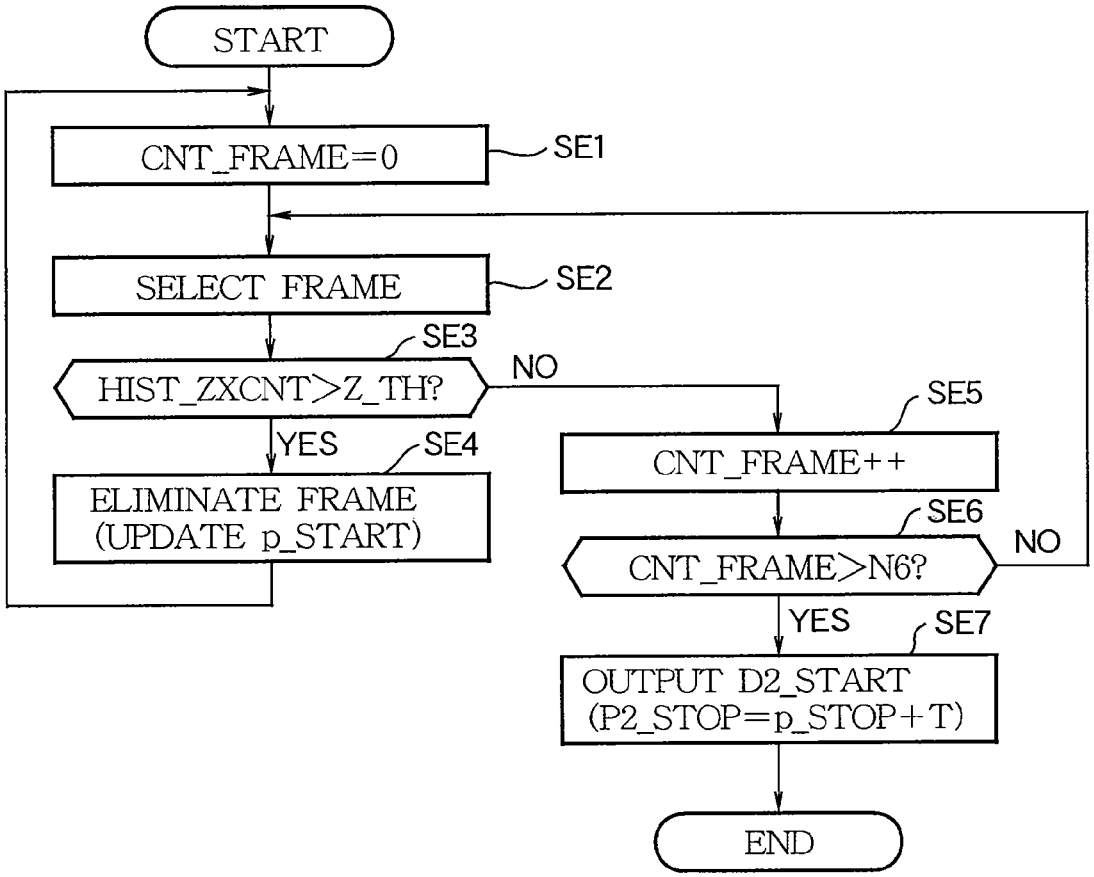
FIG. 9 is a flowchart showing processes of identifying the second utterance interval in a third embodiment.
Figure 10:
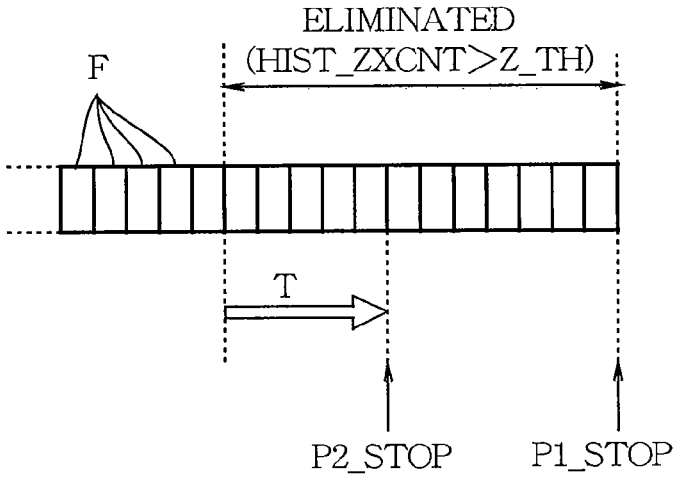
FIG. 10 is a conceptual view for explaining the processes of identifying the second utterance interval in the third embodiment.

FIG. 9 is a flowchart showing the operation of the end point identification section 44 in the second interval determination section 40, and FIG. 10 is a conceptual view for explaining the processes performed by the end point identification section 44. The end point identification section 44 initializes the variable CNT_FRAME to zero (step SE1), and then selects one frame F in the utterance interval P1 (step SE2). Each frame F is sequentially selected for each step SE2 from the last frame toward the first frame in the utterance interval P1. Then, the end point identification section 44 judges whether or not the zero-cross number HIST_ZXCNT contained in the frame information F_HIST on the frame F selected in the step SE2 is greater than a predetermined threshold value Z_TH (step SE3). The threshold value Z_TH is experimentally or statistically set in such a way that when the sound signal S in the frame F is an unvoiced consonant, the result of the step SE3 becomes YES.

When the result of the step SE3 is YES, the end point identification section 44 eliminates the frame F selected in the step SE2 from the utterance interval P1 (step SE4). That is, the end point identification section 44 selects the frame F immediately before the frame F selected in the step SE2 as a temporary end point p_STOP. Then, the end point identification section 44 moves the process to the step SE1 to initialize the variable CNT_FRAME to zero, and then executes the processes from the step SE2.

On the other hand, when the result of the step SE3 is NO, the end point identification section 44 adds "1" to the variable CNT_FRAME (step SE5), and judges whether or not the variable CNT_FRAME after the addition is greater than a predetermined value N6 (step SE6). When the result of the step SE6 is NO, the end point identification section 44 moves the process to the step SE2.

When the zero-cross number HIST_ZXCNT is greater than the threshold value Z_TH, the variable CNT_FRAME is initialized to zero (step SE1), so that the result of the step SE6 becomes YES when the zero-cross number HIST_ZXCNT is successively lower than or equal to the threshold value Z_TH for more than N6 frames F. When the result of the step SE6 is YES, the end point identification section 44 determines the point when a predetermined time length T has passed from the current last frame F (temporary end point p_STOP) as the end point P2_STOP of the utterance interval P2, and then outputs the end point data D2_STOP (step SE7). For example, when repeating the step SE4 has eliminated a plurality of (12) frames F from the end point of the utterance interval P1, as shown in FIG. 10, the point when the time length T has passed from the last frame F after the elimination is determined as the end point P2_STOP.

As described above, in this embodiment, independent of the speaker's actual speech, the voice (unvoiced consonant) at the end of the password during authentication is adjusted to the predetermined time length T, so that the accuracy of authentication performed by the sound analysis device 80 can be improved, as compared to the case where the feature values C of all frames F in the utterance interval P1 are used.

D: Variations

Various changes can be made to the above embodiments. Specific aspects of variations are illustrated in the following sections. The following aspects may be combined as appropriate.

(1) The first interval determination section 30 can employ various known technologies to identify the utterance interval P1. For example, the first interval determination section 30 may be configured to identify a group of a plurality of frames F in the sound signal S as the utterance interval P1, the magnitude of sound (energy) of each of the plurality of frames F being greater than a predetermined threshold value. Alternatively, in a configuration in which the user uses the input device 70 to instruct the start and end of pronunciation, the period from the start instruction to the end instruction may be identified as the utterance interval P1.

Similarly, the method in which the second interval determination section 40 identifies the utterance interval P2 is changed as appropriate. For example, the second interval determination section 40 may be configured to include only the start point identification section 42 or the end point identification section 44. In the configuration in which the second interval determination section 40 includes only the start point identification section 42, the period from the start point P2_START to the end point P1_STOP is identified as the utterance interval P2, the start point P2_START obtained by retarding the start point P1_START of the utterance interval P1. Similarly, in the configuration in which the second interval determination section 40 includes only the end point identification section 44, the period from the start point P1_START of the utterance interval P1 to the end point P2_STOP is identified as the utterance interval P2.

The second interval determination section 40 (the start point identification section 42 or the end point identification section 44) may be configured to execute only the processes to the step SC8 or the processes from the step SC9 in FIG. 6. Furthermore, the operations of the second interval determination section 40 in the above embodiments may be combined as appropriate. For example, the second interval determination section 40 may be configured to identify the start point P2_START or the end point P2_STOP based on both the signal level HIST_LEVEL (first embodiment) and the zero-cross number HIST_ZXCNT (third embodiment).

In the above description, although the second embodiment is configured to eliminate a frame F when both the following conditions are satisfied: the signal level HIST_LEVEL is greater than the threshold value L_TH (step SD3) and the pitch data HIST_PITCH indicates "not detected" (step SD4), the second embodiment may be configured to judge only the condition of the step SD4. As understood from the above illustrated examples, the second interval determination section 40 may be any means for determining the utterance interval P2 that is shorter than the utterance interval P1 based on the frame information F_HIST generated for each frame F.

(2) Although each of the above embodiments illustrates the configuration in which the storage section 64 is triggered by the determination of the start point P1_START or the end point P1_STOP to start or stop storing the frame information F_HIST, a similar advantage is provided in a configuration in which the frame information generation section 56 is triggered by the determination of the start point P1_START to start generating the frame information F_HIST and triggered by the determination of the end point P1_STOP to stop generating the frame information F_HIST.

The contents stored in the storage section 64 are not limited to the frame information F_HIST in the utterance interval P1. That is, the storage section 64 may be configured to store frame information F_HIST generated for all frames F in the sound signal S. However, according to the configuration in which only the frame information F_HIST in the utterance interval P1 is stored in the storage section 64 as in the above embodiments, there is provided an advantage of reduction in capacity required for the storage section 64.

(3) The information for specifying the start points (P1_START and P2_START) and the end points (P1_STOP and P2_STOP) is not limited to the number of a frame F. For example, the start point data (DL_START and D2_START) and the end point data (DL_STOP and D2_STOP) may be those specifying the start points and the end points in the form of time relative to a predetermined time (the point when the start instruction TR is issued, for example).

(4) The trigger of generation of the start instruction TR is not limited to the operation of the input device 70. For example, in a configuration in which the sound signal processing system notifies and prompts the user to start pronunciation (notification in the form of an image or voice), the notification may trigger the generation of the start instruction TR.

(5) The sound analysis device 80 performs any kind of sound analysis. For example, the sound analysis device 80 may perform speaker recognition in which the registered feature values extracted for a plurality of users are compared with the feature value C of the speaker to identify the speaker, or voice recognition in which phonemes (character data) spoken by the speaker are identified from the sound signal S. The technology used in the above embodiments to identify the utterance interval P2 (eliminate a period containing only noise from the sound signal S) is preferably employed to improve the accuracy of any sound analysis. The contents of the feature value C is selected as appropriate according to the contents of the process performed by the sound analysis device 80, and the Mel Cepstrum coefficient used in the above embodiments is only an example of the feature value C. For example, the sound signal S in the form of segmented frames F may be outputted to the sound analysis device 80 as the feature value C.

The invention claimed is:

1. A sound signal processing apparatus comprising:

a frame information generation section that generates frame information of each frame of a sound signal;

a storage section that stores the frame information generated by the frame information generation section;

a first interval determination section that determines a first utterance interval in the sound signal; and a second interval determination section that determines a second utterance interval based on the frame information of the first utterance interval stored in the storage section such that the second utterance interval is shorter than the first utterance interval and confined within the first utterance interval, wherein the frame information contains a signal index value representative of a signal level of each frame of the sound signal, and wherein the second interval determination section determines the second utterance interval by removing one or more frames from the first utterance interval according to the signal index values of the frames contained in the first utterance interval, such that the removed frames are continuous from either of a start point or an end point of the first utterance interval and that each of the removed frames has the signal index value lower than a threshold value which is determined according to a maximum signal index value of a frame contained in the first utterance interval.

2. A sound signal processing apparatus comprising:

a frame information generation section that generates frame information of each frame of a sound signal;

a storage section that stores the frame information generated by the frame information generation section;

a first interval determination section that determines a first utterance interval in the sound signal; and a second interval determination section that determines a second utterance interval based on the frame information of the first utterance interval stored in the storage section such that the second utterance interval is shorter than the first utterance interval and confined within the first utterance interval, wherein the frame information contains a signal index value representative of a signal level of each frame of the sound signal, and wherein the second interval determination section determines the second utterance interval by removing one or more frames from the first utterance interval according to the signal index values of the frames contained in the first utterance interval, such that the removed frames are continuous from a start point of the first utterance interval and selected from a set of frames continuous from the start point of the first utterance interval in case that a sum of the signal index values of the set of the frames is lower than a threshold value which is determined according to a maximum signal index value of a frame contained in the first utterance interval.

3. A sound signal processing apparatus comprising:

a frame information generation section that generates frame information of each frame of a sound signal;

a storage section that stores the frame information generated by the frame information generation section;

a first interval determination section that determines a first utterance interval in the sound signal; and a second interval determination section that determines a second utterance interval based on the frame information of the first utterance interval stored in the storage section such that the second utterance interval is shorter than the first utterance interval and confined within the first utterance interval, wherein the frame information contains a signal index value representative of a signal level of each frame of the sound signal, and wherein the second interval determination section determines the second utterance interval by removing one or more frames from the first utterance interval according to the signal index values of the frames contained in the first utterance interval, such that the removed frames are continuous from an end point of the first utterance interval and selected from a set of frames continuous from the end point of the first utterance interval in case that a sum of the signal index values of the set of the frames is lower than a threshold value which is determined according to a maximum signal index value of a frame contained in the first utterance interval.

4. A sound signal processing apparatus comprising:

a frame information generation section that generates first frame information of each frame of a sound signal and that generates second frame information of each frame of the sound signal, the second frame information being different from the first frame information;

a first interval determination section that determines a first utterance interval in the sound signal based on the first frame information; and a second interval determination section that determines a second utterance interval based on the second frame information of frames contained in the first utterance interval such that the second utterance interval is shorter than the first utterance interval and confined within the first utterance interval.

5. The sound signal processing apparatus according to claim 4, wherein the second frame information contains pitch data indicative of whether each frame of the sound signal has a detectable pitch or not, and the second interval determination section determines the second utterance interval by removing one or more frames from the first utterance interval according to the pitch data of the frames contained in the first utterance interval, such that the removed frames are continuous from either of a start point or an end point of the first utterance interval and that each of the removed frames has no detectable pitch as indicated by the respective pitch data.

6. The sound signal processing apparatus according to claim 4, wherein the second frame information contains a zero-cross number of each frame of the sound signal, and wherein the second interval determination section determines the second utterance interval by removing frames according to the zero-cross number of each frame contained in the first utterance interval, such that the removed frames are continuous from an end point of the first utterance interval, and that the removed frames are first part of a plurality of frames having zero-cross numbers greater than a threshold value while a second part of the plurality of the frames remain in an end portion of the second utterance interval.

7. The sound signal processing apparatus according to claim 4 further comprising:

an acquisition section that acquires a start instruction; and a noise level calculation section that calculates a noise level of frames of the sound signal before the acquisition section acquires the start instruction, wherein the frame information generation section includes an signal-to-noise ratio calculation section that calculates the first frame information in the form of a signal-to-noise ratio of a signal level of each frame of the sound signal after the acquisition section has acquired the start instruction relative to the noise level calculated by the noise level calculation section, and wherein the first interval determination section determines the first utterance interval based on the signal-to-noise ratio calculated for each frame of the sound signal by the signal-to-noise ratio calculation section.

8. The sound signal processing apparatus according to claim 4, further comprising:

a feature value calculation section that sequentially calculates a feature value of each frame of the sound signal, the feature value being used by a sound analysis device to analyze the sound signal; and an output control section that sequentially outputs the feature value calculated by the feature value calculation section to the sound analysis device.

9. The sound signal processing apparatus according to claim 8, wherein the first interval determination section includes start point identification section for identifying a start point of the first utterance interval, and end point identification section for identifying an end point of the first utterance interval, and wherein the output control section is triggered by the identifying of the start point made by the start point identification section to start outputting the feature value to the sound analysis device, and triggered by the identifying of the end point made by the end point identification section to stop outputting the feature value to the sound analysis device.

10. The sound signal processing apparatus according to claim 8, wherein the second frame information of each frame has a less data amount than a data amount of the feature value of each frame.

11. The sound signal processing apparatus according to claim 4, further comprising a storage section that stores the second frame information of each frame contained in the first utterance interval determined by the first interval determination section.

12. A non-transitory machine readable storage medium containing a program for use in a computer, the program being executable by the computer to perform:

a frame information generation process of generating first frame information of each frame of a sound signal and generating second frame information of each frame of the sound signal, the second frame information being different from the first frame information;

a first interval determination process of determining a first utterance interval in the sound signal based on the first frame information; and a second interval determination process of determining a second utterance interval based on the second frame information of frames contained in the first utterance interval such that the second utterance interval is shorter than the first utterance interval and confined within the first utterance interval.

13. The non-transitory machine readable storage medium according to claim 12, wherein the program is executable by the computer to further perform:

a feature value calculation process of sequentially calculating a feature value of each frame of the sound signal, the feature value being used by a sound analysis device to analyze the sound signal; and an output control process of sequentially outputting the feature value calculated in the feature value calculation process to the sound analysis device.

* * * * *